US011297924B2

(12) United States Patent
Maurin et al.

(10) Patent No.: US 11,297,924 B2
(45) Date of Patent: Apr. 12, 2022

(54) ECO-FRIENDLY COSMETIC CONTAINER

(71) Applicant: HCT GROUP HOLDINGS LIMITED, Sheung Wan (CN)

(72) Inventors: Denis Pierre Maurin, Los Angeles, CA (US); Thomas Chun, Buena Park, CA (US); Qinnong Li, Culver City, CA (US)

(73) Assignee: HCT GROUP HOLDINGS LIMITED, Hong Kong (CN)

( * ) Notice: Subject to any disclaimer, the term of this patent is extended or adjusted under 35 U.S.C. 154(b) by 69 days.

(21) Appl. No.: 16/815,959

(22) Filed: Mar. 11, 2020

(65) Prior Publication Data

US 2020/0288845 A1 Sep. 17, 2020

Related U.S. Application Data

(60) Provisional application No. 62/817,361, filed on Mar. 12, 2019.

(51) Int. Cl.

| | |
|---|---|
| ***B43K 21/08*** | (2006.01) |
| ***A45D 40/04*** | (2006.01) |
| ***A45D 40/06*** | (2006.01) |
| *A45D 40/00* | (2006.01) |
| *A45D 40/20* | (2006.01) |

(52) U.S. Cl.

CPC ..... *A45D 40/04* (2013.01); *A45D 40/06* (2013.01); *A45D 40/065* (2013.01); *A45D 2040/0062* (2013.01); *A45D 2040/208* (2013.01)

(58) Field of Classification Search

CPC ..... A45D 40/04; A45D 40/06; A45D 40/065; A45D 2040/208

USPC ..... 401/75

See application file for complete search history.

(56) References Cited

U.S. PATENT DOCUMENTS

| | | | | |
|---|---|---|---|---|
| 5,139,164 | A * | 8/1992 | Stewart | A45D 40/04 215/321 |
| 10,959,504 | B2 * | 3/2021 | Genelot | A45D 40/205 |
| 2016/0007718 | A1 | 1/2016 | Villarreal et al. | |

(Continued)

FOREIGN PATENT DOCUMENTS

| | | | |
|---|---|---|---|
| FR | 2653643 | A1 † | 5/1991 |
| FR | 2861373 | B1 † | 10/2003 |

(Continued)

OTHER PUBLICATIONS

International Search Report and Written Opinion dated Jul. 6, 2020 for International Application No. PCT/US2020/022122.

*Primary Examiner* — Jennifer C Chiang

(74) *Attorney, Agent, or Firm* — Seager, Tufte & Wickhem LLP

(57) ABSTRACT

A cosmetic container may include a base assembly including an open top and a closed bottom, and a cap configured to be removably coupled to the base assembly. The base assembly may include a helical slot on an inner surface. The cosmetic container may include a shell configured to fit within the base assembly, and a cup configured to fit within the shell. The cup may be configured to engage with the helical slot to move up and down within the cosmetic container. The cup may be configured for holding a cosmetic product stick. The base assembly, the shell, the cup and the cap may be formed from a same eco-friendly material.

20 Claims, 15 Drawing Sheets

(56) References Cited

U.S. PATENT DOCUMENTS

| | | | | |
|---|---|---|---|---|
| 2016/0174687 | A1* | 6/2016 | Ellsworth | A45D 40/04 401/65 |
| 2016/0309880 | A1 | 10/2016 | Liard | |
| 2017/0265618 | A1 | 9/2017 | Eberlein et al. | |
| 2018/0020808 | A1 | 1/2018 | Villarreal et al. | |
| 2019/0029395 | A1 | 1/2019 | Porter et al. | |

FOREIGN PATENT DOCUMENTS

| | | | |
|---|---|---|---|
| FR | 2955469 | A1 † | 7/2011 |
| WO | WO2012/114258 | A1 † | 8/2012 |

* cited by examiner
† cited by third party

ECO-FRIENDLY COSMETIC CONTAINER

CROSS REFERENCE TO RELATED APPLICATIONS

The present application claims the benefit of and priority to U.S. Provisional Application Ser. No. 62/817,361, filed on Mar. 12, 2019, titled ECO-FRIENDLY COSMETIC CONTAINER, the disclosure of which is incorporated herein by reference.

TECHNOLOGY FIELD

The present application relates generally to a cosmetic container, and in particular to a cosmetic container having an eco-friendly design.

BACKGROUND

Containers exist that are portable, convenient to use, and designed to contain products, such as cosmetics, for use. Some conventional containers are used to move (e.g., raise and lower) a product back and forth within the container between use and storage positions. These containers typically consist of a base, a lid assembly and a product holding element attached to the base, that when assembled together provide an effective container for housing and presenting a variety of products. The base, lid assembly and product holding element are typically made of a glass, a plastic, a metal, combinations of the foregoing, or the like. In many cases, the product holding element is typically made of a cheaper, more durable material, while the base and lid assembly are made from a high gloss or otherwise more attractive material, which may be more costly. One problem that arises with the use of multiple materials (e.g., glass, a variety of plastics, or metals) is the difficulty to recycle the container appropriately, as the multiple materials need to be separated so they can be recycled properly. Accordingly, there remains a need in the art for improved, eco-friendly containers.

SUMMARY

This disclosure provides design, material, manufacturing methods, and use alternatives for cosmetic packaging.

In a first non-limiting example, a cosmetic container may include a base assembly including an outer base having an open top and a closed bottom, and a collar which may be configured to fit within the outer base through the open top of the outer base. The outer base may have a plurality of notches on an inner surface of the outer base. The collar may have an open top and an open bottom, a helical slot and a channel on an inner surface of the collar. The collar may include an outer ridge on an outer surface of the collar, and may include a plurality of ridges on the outer surface of the collar which may be configured to engage with the plurality of notches on the inner surface of the outer base. The collar may further include at least one protrusion on the outer surface of the collar. The cosmetic container may include a shell, which may be configured to fit within the collar through the open top of the collar. The shell may have an open top and an open bottom, an outer ridge which may be configured to engage with the channel on the inner surface of the collar to secure the shell to the base assembly, and at least one longitudinal slot extending from the open bottom. A cup may be configured to fit within the shell through the open top of the shell. The cup may include an open top and an open bottom, wherein the cup may include at least one post on an outer surface of the cup configured to extend through the at least one longitudinal slot of the shell and interact with the helical slot of the collar. The cosmetic container may include a cap that may be removably coupled to the base assembly. The cap may have an inner channel on an inner surface of the cap, which may be configured to engage with the at least one protrusion on the outer surface of the collar to secure the cap to the base assembly. The base assembly, the shell, the cup and the cap may be formed from a same material.

Alternatively, or additionally, in another example, the material may be polyethylene terephthalate glycol.

Alternatively, or additionally, in another example, rotation of the base assembly relative to the shell in a first direction may cause the at least one post on the outer surface of the cup to move along the helical slot of the collar thereby raising the cup.

Alternatively, or additionally, in another example, rotation of the base assembly relative to the shell in a second direction may cause the at least one post on the outer surface of the cup to move along the helical slot of the collar thereby lowering the cup.

Alternatively, or additionally, in another example, the cup may be configured to hold a cosmetic product.

Alternatively, or additionally, in another example, the cap and the base assembly may have generally the same shape.

Alternatively, or additionally, in another example, the cup may include a ledge within the cup which may create a cavity to hold the cosmetic product.

Alternatively, or additionally, in another example, the cap may be secured to the base assembly in a snap-fit fashion.

Alternatively, or additionally, in another example, the cup may include at least two posts on an outer surface of the cup which may be configured to extend through the at least one longitudinal slot of the shell and interact with the helical slot of the collar.

According to another example, a cosmetic container may include a base assembly which may include an outer base having an open top and a closed bottom, and a collar which may be configured to fit within the outer base through the open top of the outer base. The outer base may have a plurality of notches on an inner surface of the outer base. The collar may have an open top and an open bottom, a helical slot and a channel on an inner surface of the collar. The collar may further include an outer ridge on an outer surface of the collar, a plurality of ridges on the outer surface of the collar which may be configured to engage with the plurality of notches on the inner surface of the outer base, and at least one protrusion on the outer surface of the collar. The cosmetic container may include a shell which may be configured to fit within the collar through the open top of the collar. The shell may have an open top and an open bottom, an outer ridge configured to engage with the channel on the inner surface of the collar to secure the shell to the base assembly, and at least one longitudinal slot extending from the open bottom. A cup may be configured to fit within the shell through the open top of the shell. The cup may have an open top and an open bottom, and the cup may include at least one post on an outer surface of the cup which may be configured to extend through the at least one longitudinal slot of the shell and interact with the helical slot of the collar. A cap may be removably coupled to the base assembly. The cap may have an inner channel on an inner surface of the cap which may be configured to engage with the at least one protrusion on the outer surface of the collar to secure the cap to the base assembly. Rotation of the base assembly relative to the shell in a first direction may cause the at least one post on the outer surface of the cup to move along the helical slot of the collar thereby raising the cup, and rotation of the base assembly relative to the shell in a second direction may cause the at least one post on the outer surface of the cup to move along the helical slot of the collar thereby lowering the cup.

Alternatively, or additionally, in another example, the base assembly, the shell, the cup and the cap may be formed from a same material.

Alternatively, or additionally, in another example, the material may be polyethylene terephthalate glycol.

Alternatively, or additionally, in another example, the cup may be configured to hold a cosmetic product.

Alternatively, or additionally, in another example, the cup may include a ledge within the cup thereby creating a cavity to hold the cosmetic product.

According to another example, a cosmetic container may include a base assembly which may include an outer base having an open top and a closed bottom, and a collar which may be configured to fit within the outer base through the open top of the outer base. The collar may include a helical slot and a channel on an inner surface of the collar. A shell may be configured to fit within the collar through the open top of the collar, and the shell may include at least one longitudinal slot extending from the open bottom. A cup may be configured to fit within the shell through the open top of the shell. The cup may have an open top and an open bottom, and the cup may include at least one post on an outer surface of the cup which may be configured to extend through the at least one longitudinal slot of the shell and interact with the helical slot of the collar. The cosmetic container may include a cap which may be configured for coupling to the base assembly. The cup may include a ledge within the cup which may create a cavity to hold a cosmetic product. The base assembly, the shell, the cup and the cap may be formed from a same material.

Alternatively, or additionally, in another example, the material may be polyethylene terephthalate glycol.

Alternatively, or additionally, in another example, the shell may include an outer ridge which may be configured to engage with the channel on the inner surface of the collar to secure the shell to the base assembly.

Alternatively, or additionally, in another example, rotation of the base assembly relative to the shell in a first direction may cause the at least one post on the outer surface of the cup to move along the helical slot of the collar thereby raising the cup.

Alternatively, or additionally, in another example, rotation of the base assembly relative to the shell in a second direction may cause the at least one post on the outer surface of the cup to move along the helical slot of the collar thereby lowering the cup.

Alternatively, or additionally, in another example, the cap may be secured to the base assembly in a snap-fit fashion.

The above summary of some example embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF EXEMPLARY EMBODIMENTS

Figure 1:
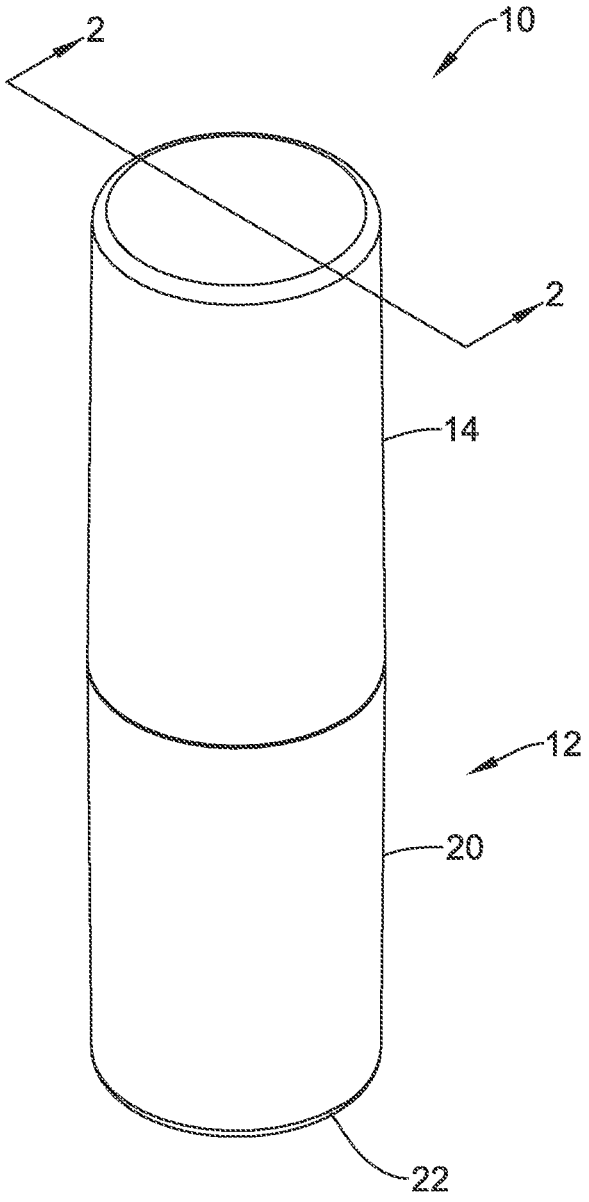
FIG. 1 is a perspective view of an illustrative cosmetic container.

The following description should be read with reference to the drawings wherein the like reference numerals indicate like elements throughout the several views. The description and drawings show several embodiments which are meant to be illustrative in nature.

For convenience, the present disclosure may be described using relative terms including, for example, left, right, top bottom, front, back, upper, lower, up, and down, as well as others. It is to be understood that these terms are merely used for illustrative purposes and are not meant to be limiting in any manner.

FIG. 1 is a perspective view of an illustrative cosmetic container 10 in a closed configuration. The cosmetic container 10 may be used to apply a cosmetic product to the face or other parts of the body. The cosmetic container 10 may be used with cosmetic product sticks such as lip stick, lip liner, lip balm, eye liner, eye shadow, eyebrow pencil, concealer, foundation, blush, deodorant, sunscreen or any other cosmetic or personal care product formulated as a solid or semi-solid stick.

The cosmetic container 10 shown in FIG. 1, may include a cap 14 and a base assembly 12. The base assembly 12 may include an outer base 20, as shown in FIG. 1 and a collar 30, which is not visible when the cosmetic container 10 is in the closed configuration. As shown in FIG. 1, the outer base 20 may include a closed bottom 22. The cosmetic container 10 may be cylindrical in shape, with a circular cross-section, as shown in FIGS. 1-4. Alternatively, the cosmetic container 10 may have a cross-sectional shape that is square, rectangular, triangular, oval, or any other desired shape.

Figure 2:
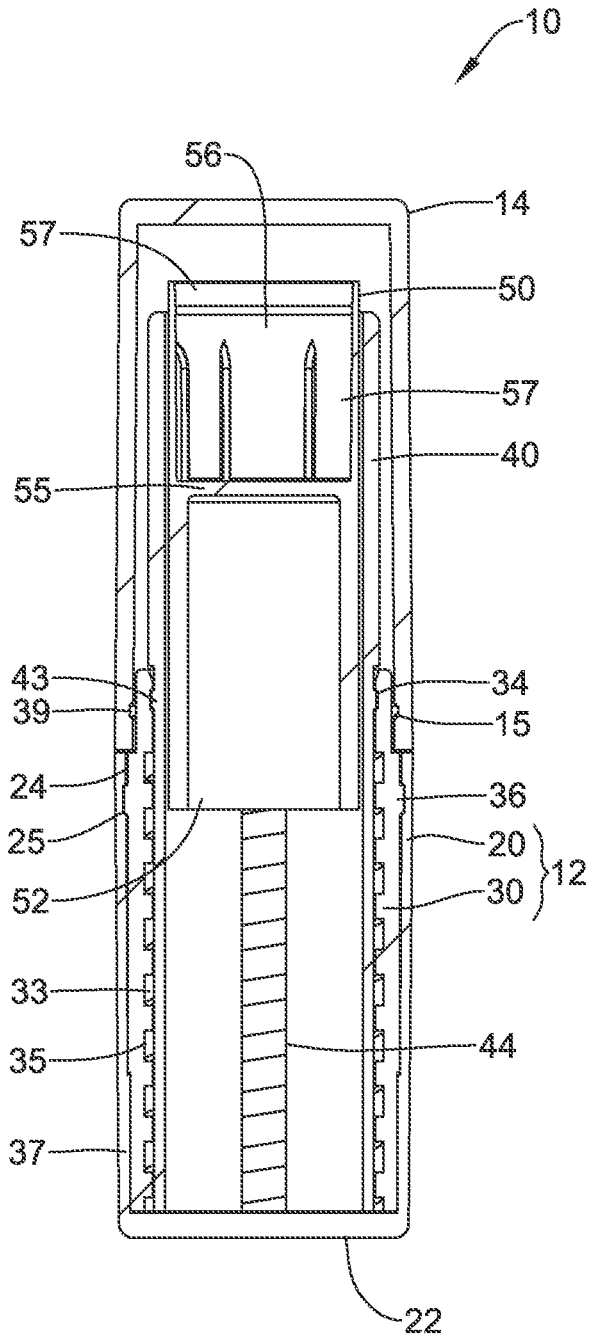
FIG. 2 is a cross-sectional view of the illustrative cosmetic container taken along line 2-2 in FIG. 1.

FIG. 2 is a cross-sectional view of the illustrative cosmetic container 10 taken along line 2-2 in FIG. 1. As shown in FIG. 2, the base assembly 12 may include the outer base 20 and the collar 30. As discussed with reference to FIG. 1, the outer base 20 may include the closed bottom 22. The outer base 20 may further include an open top 21, and an inner slot 25 on an inner surface 24 of the outer base 20. The open top 21 and the inner surface 24 are shown in more detail in FIGS. 5A and 5B.

The collar 30 may be configured to fit within the outer base 20 through the open top 21 of the outer base 20. The collar 30 may include an inner surface 35 and an outer surface 37. The collar 30 may include an outer ridge 36 on the outer surface 37 of the collar 30 which may be configured to engage with the inner slot 25 of the outer base 20 to couple the collar 30 to the outer base 20. The collar 30 may include one or more protrusions 39 on the outer surface 37. The collar 30 may further include a helical slot 33 that extends around the inner surface 35, and a channel 34 on the inner surface 35 of the collar 30. The outer base 20 and the collar 30 may be formed as separate pieces fixed together, as shown in FIGS. 2, 3 and 4, however, it may be contemplated that the outer base 20 and the collar 30 may be formed as a single monolithic piece.

The cosmetic container 10 may include a shell 40 which may be configured to sit within the base assembly 12. The shell 40 may have an open top 41, an open bottom 42, and an interior 46 of the shell 40 may be hollow. The shell 40 may include at least one longitudinal slot 44 which may extend along an outside 45 of the shell 40 from the open bottom 42 in a vertical direction, thereby permitting access to the hollow interior 46. The shell 40 may further include an outer ridge on the outside 45 of the shell 40 which may be configured to interact with the channel 34 of the collar 30 to secure the shell 40 to the base assembly 12. A cup 50 may be configured to fit within the shell 40 through the open top 41 of the shell 40. The cup 50 may include an open top 51 and an open bottom ix) 52. The cup 50 may include a ledge 55 within an interior 57 of the cup 50 which may provide a cavity 56 within the cup 50 for holding a product.

The cosmetic container 10 may include a cap 14 having an inner channel 15 on an inner surface 16 of the cap 14. The inner channel 15 may configured to engage with the one or more protrusions 39 of the collar 30 to couple the cap 14 to the base assembly 12, such that when assembled together, the cap 14 and the base assembly 12 provide an effective barrier for containing the product. The cap 14 and the base assembly 12 may have a substantially cylindrical shape and the seal may be provided in a snap-fit fashion. However, it may be contemplated that the cap 14 and the base assembly 12 may have an alternative shape (e.g., square, rectangular, oval, triangular, or any other shape desired) and may be secured together or sealed by a magnetic fastening mechanism, a thread fastening mechanism, or a clamp fastening system. It may be further contemplated that the cap 14 and the outer base 20 have one shape and the sealing mechanism (e.g., the collar 30 and the inner surface 16 of the cap 14) have a second, substantially round shape, wherein the seal may be provided by a thread fastening mechanism. Some assemblies, when fastened together, can compress an O-ring or a gasket interposed by the cap 14 and the base assembly 12 to provide airtight sealing. Other examples may not be airtight and may simply serve to effectively contain and prevent spillage of the cosmetic product therein.

Figure 3:
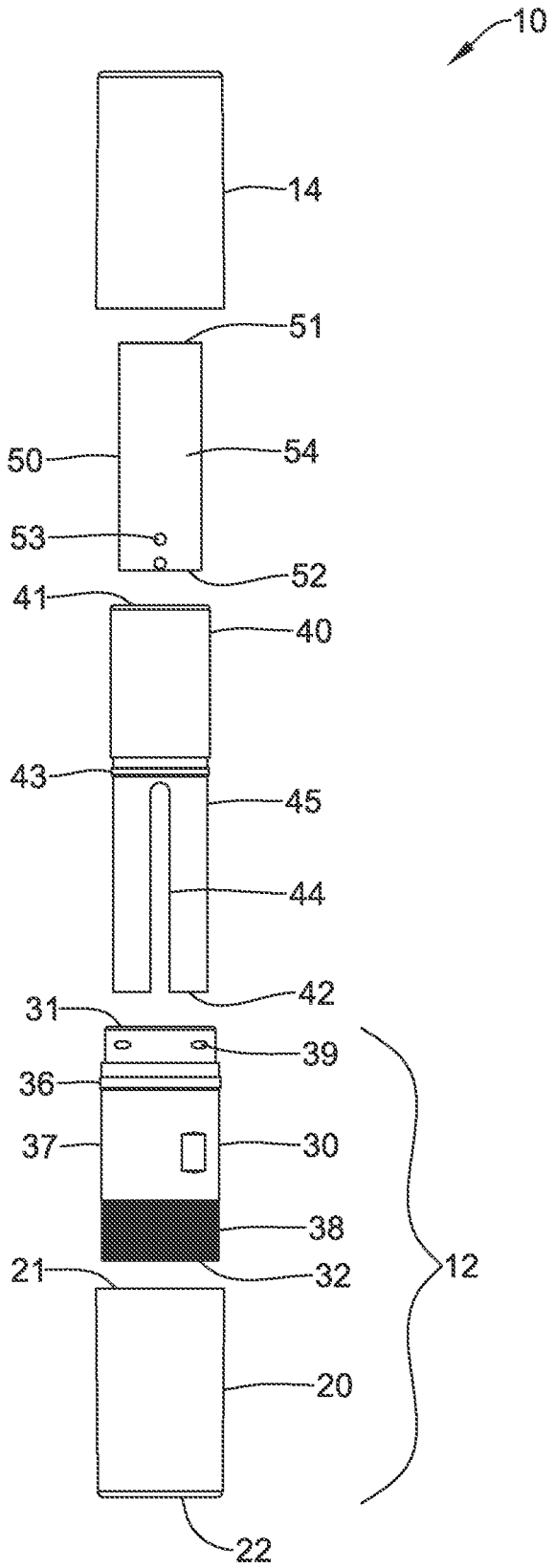
FIG. 3 is an exploded view of the illustrative cosmetic container.

FIG. 3 is an exploded view of the illustrative cosmetic container 10. As discussed with reference to FIG. 2, the cosmetic container 10 may include a base assembly 12 which may include the outer base 20 and the collar 30. The outer base 20 may include the open top 21 and the closed bottom 22. The collar 30 may be configured to fit within the outer base 20 through the open top 21 of the outer base 20. The collar may have the open top 31 and the open bottom 32. The outer surface 37 of the collar 30 may include a plurality of ridges 38, the outer ridge 36, and the one or more protrusions 39.

The shell 40 may be configured to fit within the base assembly 12 through the open top 31 of the collar 30. The shell 40 may include the open top 41, the open bottom 42, and the at least one longitudinal slot 44. The outside 45 of the shell 40 may include the outer ridge 43 which may be configured to couple the shell 40 to the base assembly 12. The cup 50 may be configured to fit within the shell 40 through the open top 41 of the shell 40. The cup 50 may include the open top 51 and the open bottom 52. An outer surface 54 of the cup 50 may include one or more posts 53 which may be configured to engage with the helical slot 33 of the collar 30, as discussed in further detail with reference to FIG. 4. The cosmetic container 10 may include the cap 14 which when coupled to the base assembly 12 may serve to provide an effective barrier for containing the product. In some embodiments, the outer base 20, the collar 30, the shell 40, the cup 50 and the cap 14 may be formed from the same material. Suitable recyclable materials may include high-density polyethylene (HDPE), polyethylene terephthalate glycol (PETG), polyethylene terephthalate (PET), post-consumer recycled (PCR), and/or any other suitable recyclable material. In some embodiments the components of the cosmetic container 10 may comprise a transparent or translucent material so that the cosmetic product within may be externally viewed and/or for decorative purposes. In some examples a non-recyclable material may be used instead. For example, biodegradable plastic materials may be used; PET is an example of a biodegradable plastic, as well as various polymers derived from starch sources and/or polylactic acid (PLA).

Figure 4A:
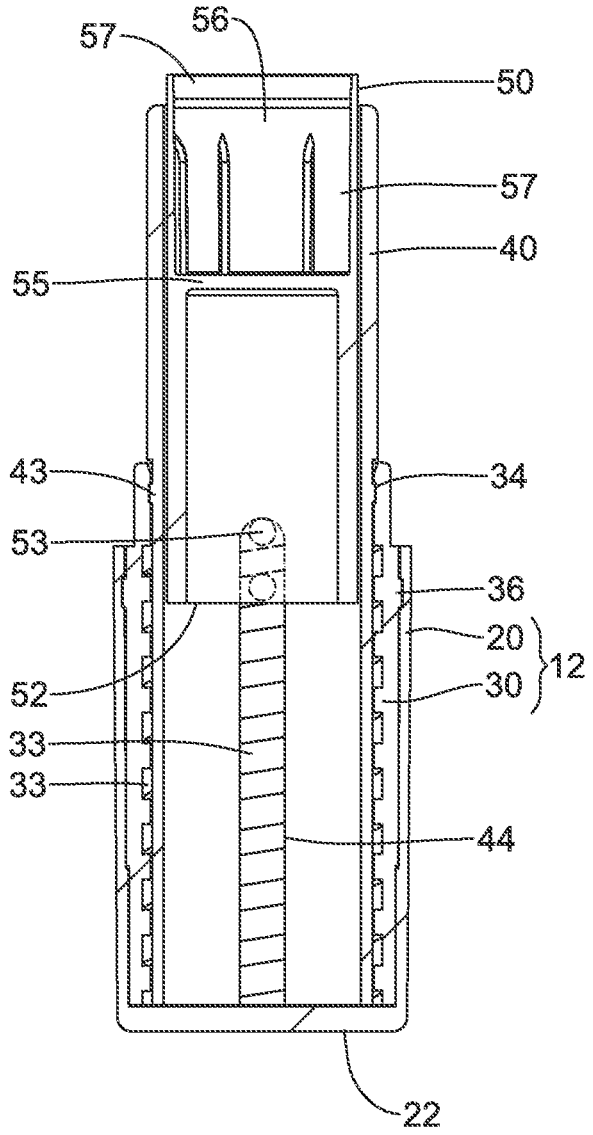
FIG. 4A is a cross-sectional view of the illustrative cosmetic container taken along line 2-2 in FIG. 1, with the cap removed and the cup shown in phantom, where the cup is in a first position.
Figure 4B:
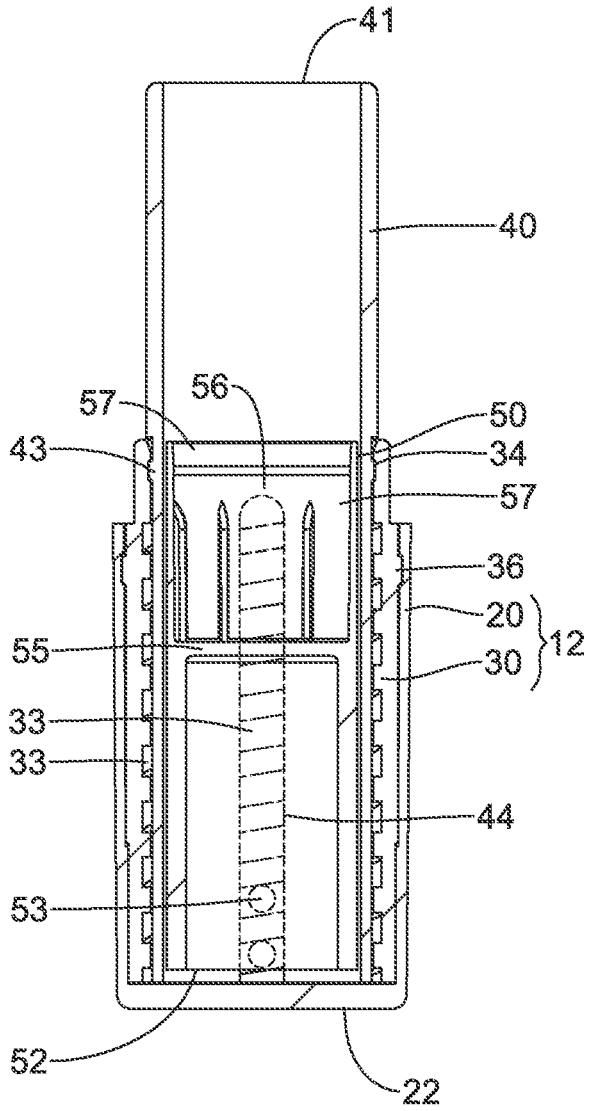
FIG. 4B is a cross-sectional view of the illustrative cosmetic container taken along line 2-2 in FIG. 1, with the cap removed and the cup shown in phantom, where the cup in a second position.

FIGS. 4A and 4B are cross-sectional views of the illustrative cosmetic container 10 taken along line 2-2 in FIG. 1, with the cap 14 removed and the cup 50 shown in phantom. As shown in FIG. 4A, the cup 50 may be in a first position, where the one or more posts 53 of the cup 50 may be configured to engage with the helical slot 33 near the open top 31 of the collar 30. The longitudinal slot 44 of the shell 40 may provide access to the helical slot 33. In this manner, the one or more posts 53 extend through the opening provided by the longitudinal slot 44 and reside within the helical slot 33. The base assembly 12 may rotate relative to the shell 40 thereby effectively moving the cup 50 up (as shown in FIG. 4A) or down (as shown in FIG. 4B) within the shell 40. When the base assembly 12 rotates, the shell 40 may be fixed against rotation and axial movement relative to the base assembly 12. The one or more posts 53 are held within the helical slot 33 via the longitudinal slot 44, thereby preventing the cup 50 from rotating with the base assembly 12. In some cases, the base assembly 12 may rotate relative to the shell 40 in a first direction which may cause the one or more posts 53 to move along the helical slot 33 of the collar 30 up towards the open top 31 of the collar 30, thereby raising the cup 50 within the shell 40.

As shown in FIG. 4B, the cup 50 may be in a second position, where the one or more posts 53 of the cup 50 may be configured to engage with the helical slot 33 near the open bottom 32 of the collar 30. As discussed above, the one or more posts 53 extend through the opening provided by the longitudinal slot 44 and reside within the helical slot 33. In some cases, the base assembly 12 may rotate relative to the shell 40 in a second direction which may cause the one or more posts 53 to move along the helical slot 33 of the collar 30 down towards the open bottom 32 of the collar 30, thereby lowering the cup 50 within the shell 40. The cup 50 may be configured to hold a product, such as a cosmetic product stick (not shown). The product stick may be extended and retracted through the open top 41 of the shell 40, thereby providing access to the product stick. In some cases, when the product stick is new, the cup 50 may be in the second position, as shown in FIG. 4B. As the product stick is used (e.g., depleted), the cup 50 may be moved along the helical slot 33 in the first direction to raise the cup 50 and provide access to the product stick through the open top 41 of the shell 40.

Figure 5A:
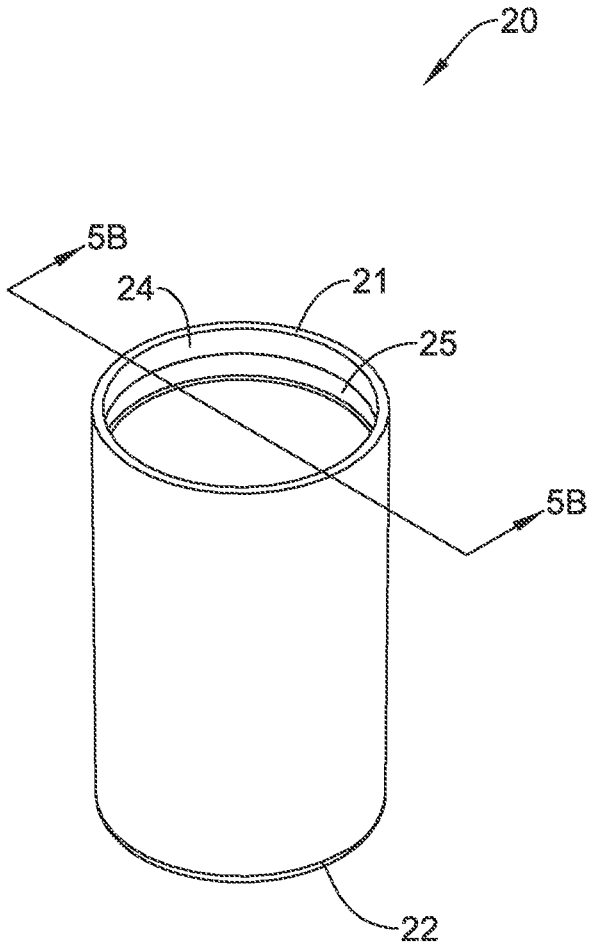
FIG. 5A is a perspective view of an illustrative outer base of the illustrative cosmetic container.
Figure 5B:
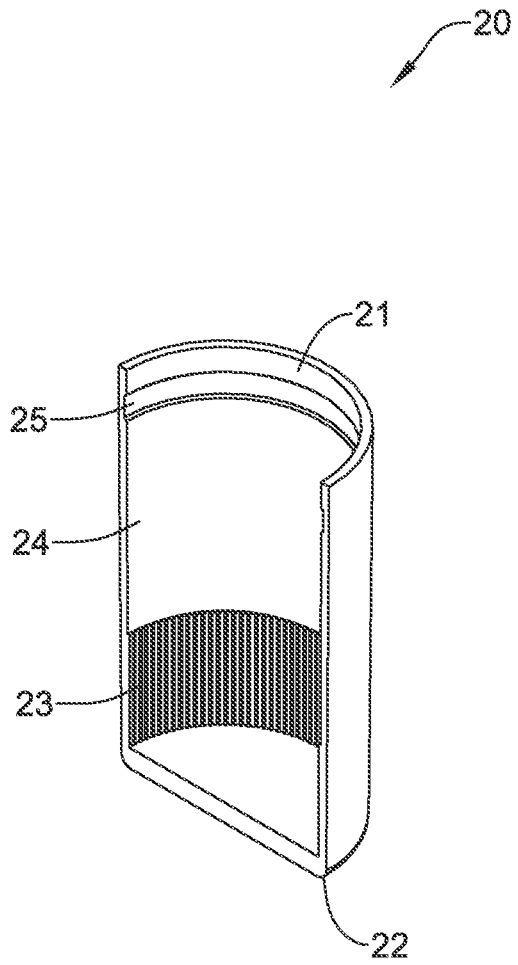
FIG. 5B is a cross-sectional view of the illustrative outer base taken along line 5B-5B in FIG. 5A.

FIGS. 5A and 5B depict the illustrative outer base 20 of the illustrative cosmetic container 10. As shown in FIGS. 5A and 5B, the outer base 20 may include the inner slot 25 on the inner surface 24 near the open top 21 of the outer base 20. The inner slot 25 is configured to interact with the outer ridge 36 of the collar 30 to secure the outer base 20 and the collar 30 to one another. As shown in FIG. 5B, which is a cross-sectional view of the outer base 20, the outer base 20 may further include a plurality of notches 23 on the inner surface 24. The plurality of notches 23 may be configured to engage with the plurality of ridges 38 of the collar 30 such that the outer base 20 is fixed against rotation relative to the collar 30. In this manner, the outer base 20 and the collar 30 rotate as one unit (e.g., the base assembly 12). While the outer base 20 and the collar 30 are shown as separate pieces, it may be contemplated that they may be formed as one structure.

Figure 6A:
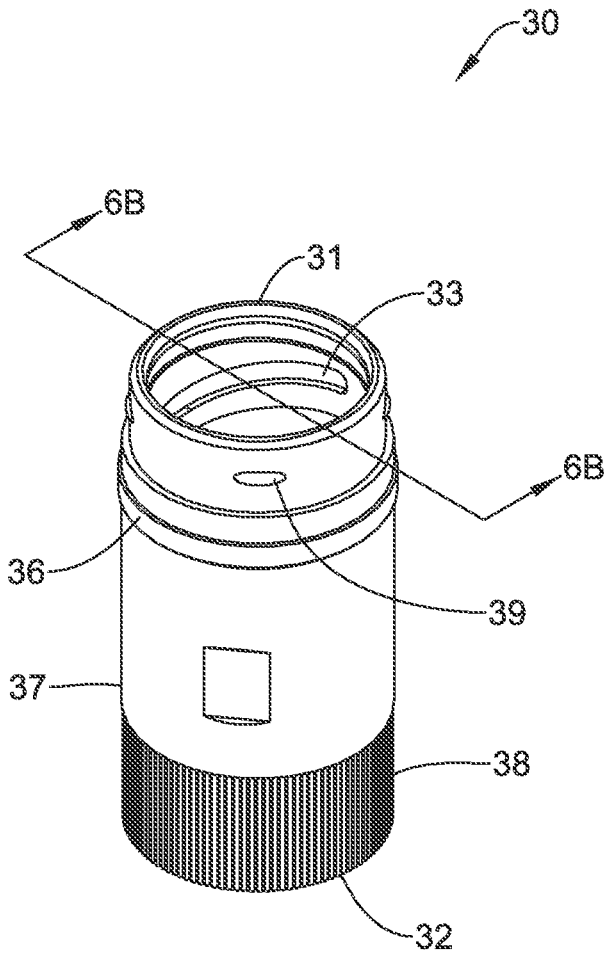
FIG. 6A is a perspective view of an illustrative collar of the illustrative cosmetic container.
Figure 6B:
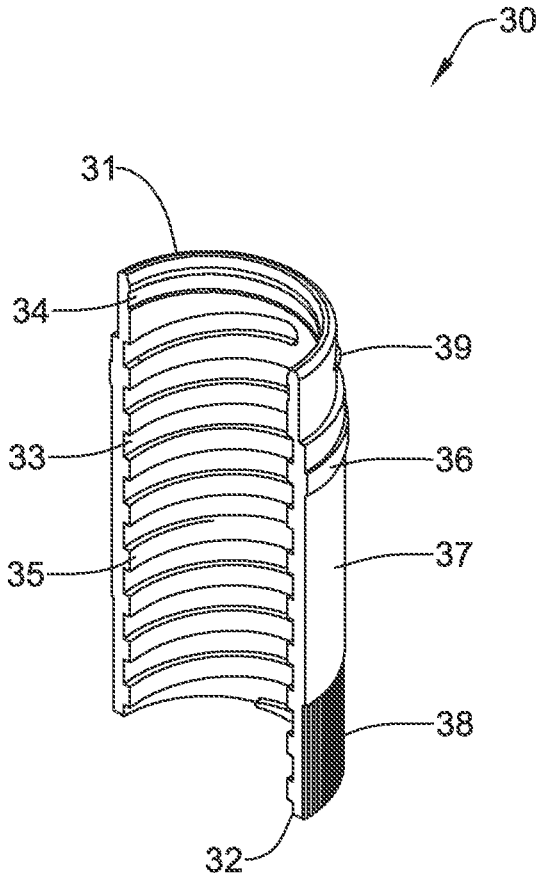
FIG. 6B is a cross-sectional view of the illustrative collar taken along line 6B-6B in FIG. 6A.

FIGS. 6A and 6B depict the illustrative collar 30 of the illustrative cosmetic container 10. As shown in FIGS. 6A and 6B, the collar 30 may include the open top 31 and the open bottom 32. The collar 30 may include a helical slot 33 which extends around the inner surface 35 of the collar 30. The collar 30 may include a plurality of ridges 38 on the outer surface 37 of the collar 30. As stated above with reference to FIG. 5B, the plurality of ridges 38 may be configured to engage with the plurality of notches 23 of the outer base 20 such that the collar 30 is fixed against rotation relative to the outer base 20. The collar 30 may further include an outer ridge 36 which may be configured to interact with the inner slot 25 of the outer base 20 to secure the collar 30 to the outer base 20. The outer surface 37 of the collar 30 may include one or more protrusions 39 located near the open top 31 of the collar 30. The one or more protrusions 39 may be configured to engage with the inner channel 15 of the cap 14 to couple the cap 14 to the base assembly 12.

FIG. 6B, which is a cross-sectional view of the collar 30, shows the helical slot 33 on the inner surface 35 in more detail. As can be seen in FIG. 6B, the helical slot 33 extends around the inner surface 35 of the collar 30 from a position near the open top 31 to a position near the open bottom 32 of the collar 30. The helical slot 33 is configured to interact with the one or more posts 53 such that the cup 50 may move axially within the cosmetic container 10. The collar 30 may further include the channel 34 on the inner surface 35 of the collar 30. The channel 34 may be configured to engage with the outer ridge 43 of the shell 40, thereby securing the shell 40 in a fixed position within the base assembly 12.

Figure 7A:
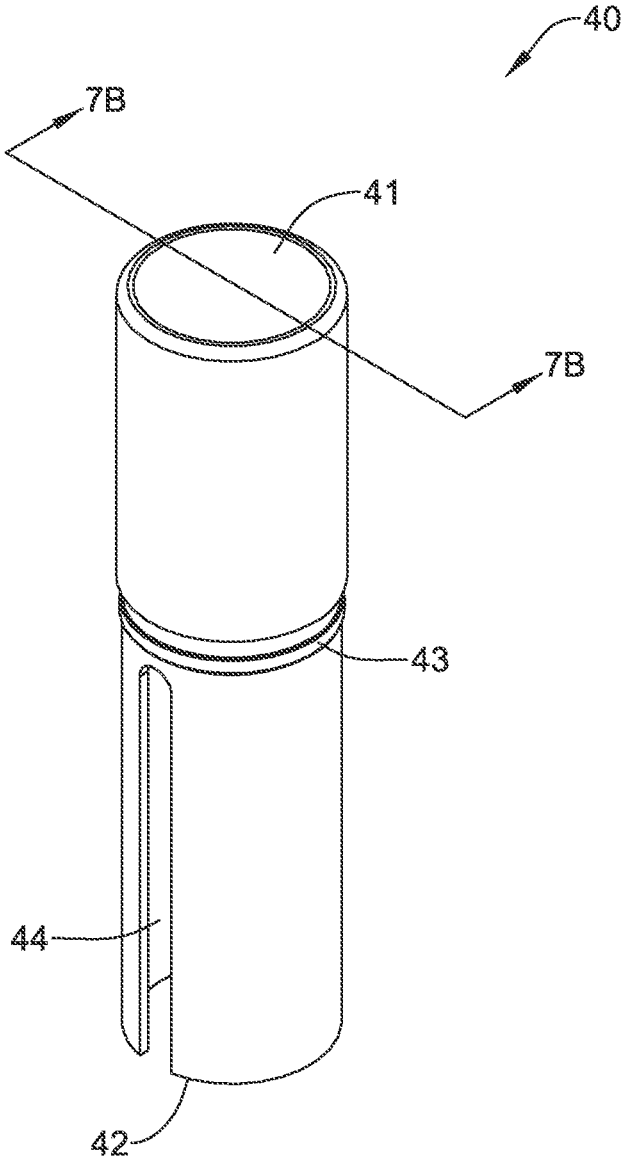
FIG. 7A is a perspective view of an illustrative shell of the illustrative cosmetic container.
Figure 7B:
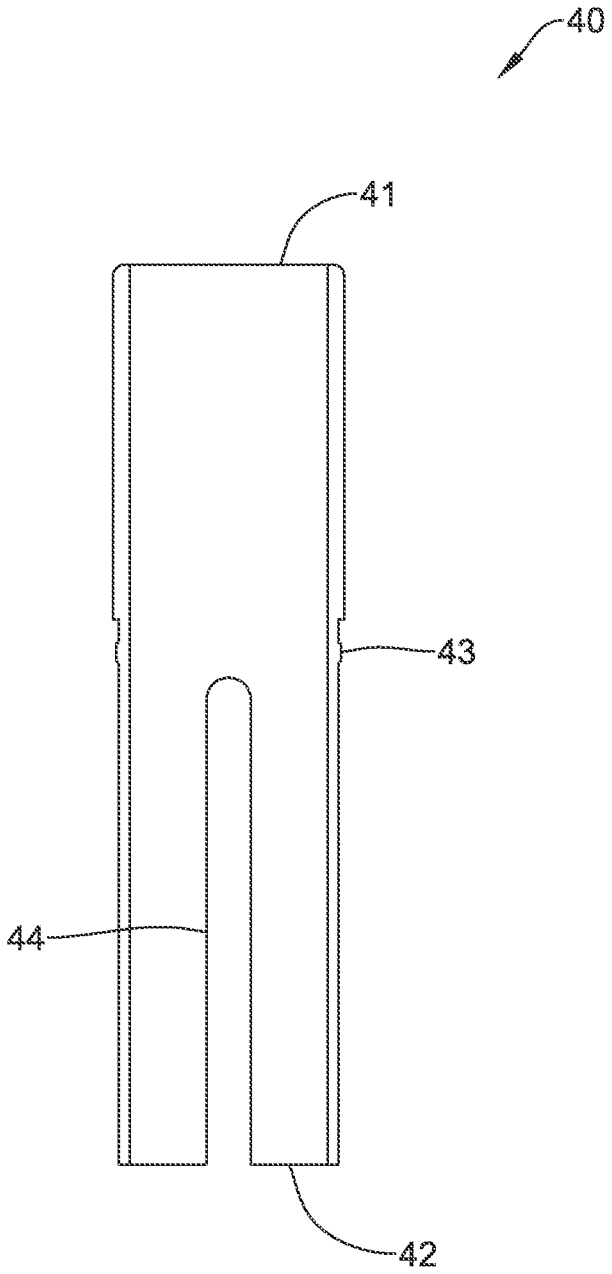
FIG. 7B is a cross-sectional view of the illustrative shell taken along line 7B-7B in FIG. 7A.

FIGS. 7A and 7B depict the illustrative shell 40 of the illustrative cosmetic container 10. As discussed above with reference to FIGS. 2 and 3, the shell 40 may be configured to sit within the base assembly 12. The shell 40 may have a size such that the open bottom 42 of the shell 40 abuts the closed bottom 22 of the outer base 20, and a portion of the shell 40 extends out of the open top 31 of the collar 30. The shell 40 may have the open top 41, the open bottom 42, and the interior 46 of the shell 40 may be hollow, as shown in FIG. 7B, which is a cross-sectional view of the shell 40. The shell 40 may be sized and shaped to receive the cup 50 which may hold a cosmetic product stick. The shell 40 may provide a protective barrier for the cosmetic product stick which would prevent the cosmetic product stick from being easily broken.

The shell 40 may include at least one longitudinal slot 44 which may extend along and through the outside 45 of the shell 40 from the open bottom 42 in a vertical direction, thereby permitting access to the helical slot 33 the full length of the inner surface 35 of the collar 30. The shell 40 may further include the outer ridge on the outside 45 of the shell 40 which may be configured to interact with the channel 34 of the collar 30 to secure the shell 40 to the base assembly 12 in a snap-fit fashion. When the shell 40 is secured to the base assembly 12, the shell 40 may remain in a fixed position such that axial movement and/or rotation is prohibited. The base assembly 12 may be rotated relative to the shell 40 due to the shell 40 remaining in a fixed position. The fixed position of the shell 40 further prevents the cup 50 from rotating with the base assembly 12 as the one or more posts 53 are held within the helical slot 33 via the longitudinal slot 44. The rotation of the base assembly 12 relative to the shell 40 permits the one or more posts 53 to move along the helical slot 33, thereby causing the cup 50 to move axially within the shell 40.

Figure 8A:
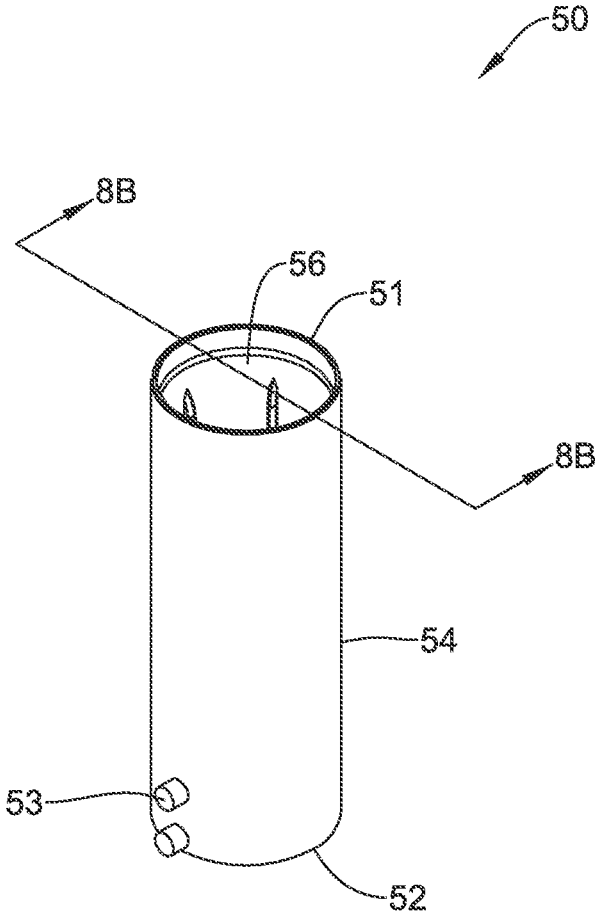
FIG. 8A is a perspective view of an illustrative cup of the illustrative cosmetic container.
Figure 8B:
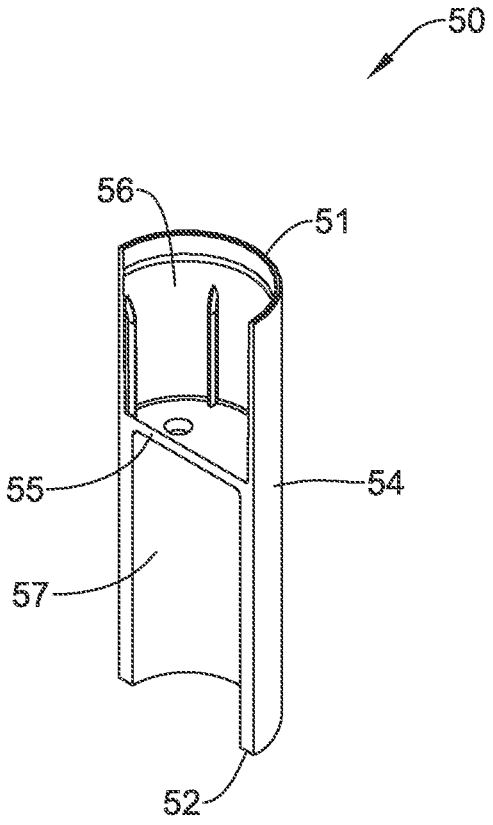
FIG. 8B is a cross-sectional view of the illustrative cup taken along line 8B-8B in FIG. 8A.

FIGS. 8A and 8B depict the illustrative cup 50 of the illustrative cosmetic container 10. The cup 50 may be configured to fit within the shell 40 through the open top 41 of the shell 40. The cup 50 may include the open top 51 and the open bottom 52. The outer surface 54 of the cup 50 may include one or more posts 53 which may be configured to engage with the helical slot 33 of the collar 30. The longitudinal slot 44 of the shell 40 may provide access to the helical slot 33. In this manner, the one or more posts 53 extend through the opening provided by the longitudinal slot 44 and reside within the helical slot 33. The base assembly 12 may rotate relative to the shell 40 and the one or more posts 53 may move along the helical slot 33, thereby effectively moving the cup 50 up (as shown in FIG. 4A) or down (as shown in FIG. 4B) within the shell 40. When the base assembly 12 rotates, the shell 40 may be fixed against rotation and axial movement relative to the base assembly 12. The one or more posts 53 are held within the helical slot 33 via the longitudinal slot 44, thereby preventing the cup 50 from rotating with the base assembly 12.

As shown in FIG. 8B, which is a cross-sectional view of the cup 50, the cup 50 may include the ledge 55 within the interior 57 of the cup 50 which may provide a cavity 56 within the cup 50 for holding a product. The product may be a cosmetic product stick such as lip stick, lip liner, lip balm, eye liner, eye shadow, eyebrow pencil, concealer, foundation, blush, deodorant, and sunscreen or any other cosmetic or personal care product formulated as a solid or semi-solid stick. The cosmetic product stick may be coupled to the cup 50 by a friction fit, adhesive, crimping element, or any other conventional means of coupling a cosmetic product stick to a holder.

Figure 9A:
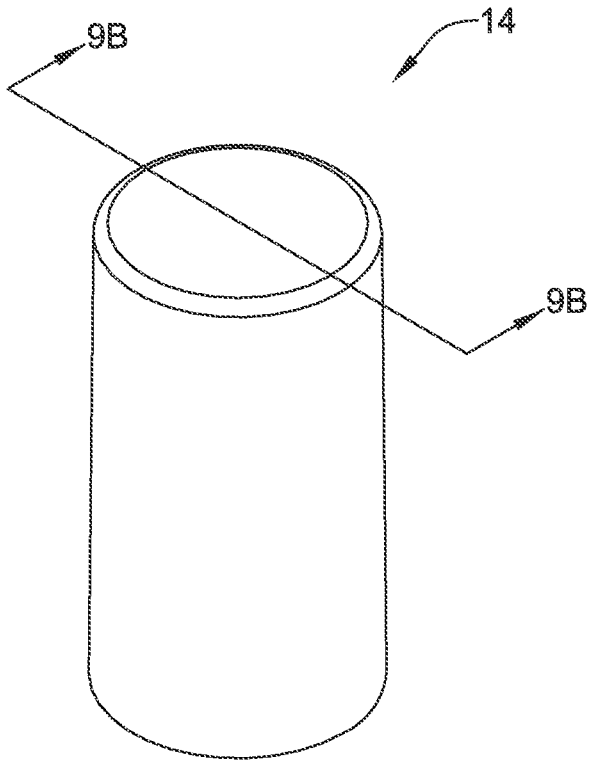
FIG. 9A is a perspective view of an illustrative cap of the illustrative cosmetic container.
Figure 9B:
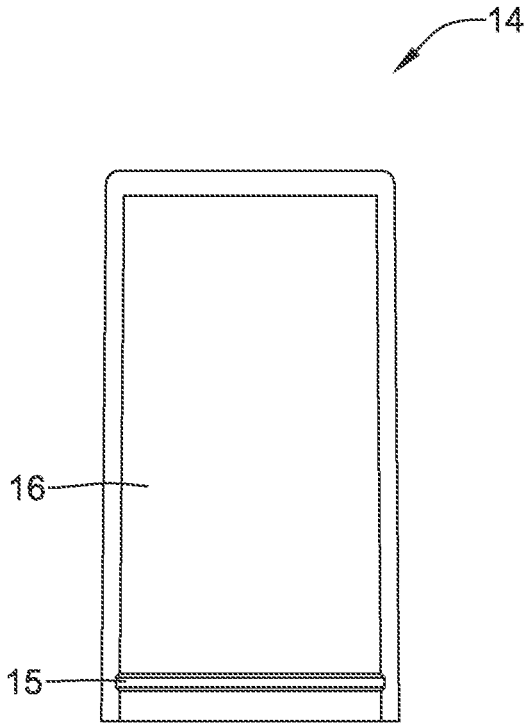
FIG. 9B is a cross-sectional view of the illustrative cap taken along line 9B-9B in FIG. 9A.

FIGS. 9A and 9B depict the illustrative cap 14 of the illustrative cosmetic container 10. The cap 14 may have the inner channel 15 on the inner surface 16 of the cap 14, as shown in FIG. 9B, which is a cross-sectional view of the cap 14. The inner channel 15 may configured to engage with the one or more protrusions 39 of the collar 30 to couple the cap 14 to the base assembly 12, such that when assembled together, the cap 14 and the base assembly 12 provide an effective barrier for containing the product. The cap 14 may be coupled to base assembly via the one or more protrusions 39 by friction fit or a snap-fit. Alternatively, the cap 14 may be coupled to the base assembly 12 via a magnetic fastening mechanism, a thread fastening mechanism, or a clamp fastening system or any other suitable fastening mechanism.

The components of the cosmetic container 10 (e.g., outer base 20, collar 30, shell 40, cup 50 and cap 14) as shown and described above may be made of any suitable material such as, for example, thermoplastic elastomer (TPE), low density polyethylene (LDPE), synthetic polymer, partially of a resin such as, for example, acrylonitrile butadiene styrene (ABS), styrene acrylonitrile (SAN), pentachlorothioanisole (PCTA), polypropylene (PP), polyethylene (PE), polyurethane, rubber, silicone, composite material, polyethylene terephthalate glycol (PETG), polyethylene terephthalate (PET), post-consumer recycled (PCR), high-density polyethylene (HDPE), and/or the like. In a preferred embodiment, the components of the cosmetic container 10 may all be formed from the same material such that the cosmetic container 10 may be easily recycled. In an example, all of the components are made of PETG.

For the following defined terms, these definitions shall be applied, unless a different definition is given in the claims or elsewhere in this specification. In this document, the terms "a" or "an" are used, as is common in patent documents, to include one or more than one, independent of any other instances or usages of "at least one" or "one or more" unless the content clearly dictates otherwise. Moreover, in the following claims, the terms "first," "second," and "third," etc. are used merely as labels, and are not intended to impose numerical requirements on their objects. The above description is intended to be illustrative, and not restrictive.

As used in the above description and the appended claims, the term "or" is generally employed in its sense including "and/or" unless the content clearly dictates otherwise.

The above described embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. For example, the above examples (or one or more aspects thereof) may be used in combination with each other. Other embodiments can be used, such as by one of ordinary skill in the art upon reviewing the above description.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that all the appended claims be construed to cover all such equivalent variations a fall within the true spirit and scope of the invention.

What is claimed is:

1. A cosmetic container comprising:

a base assembly including an outer base having an open top and a closed bottom, and a collar configured to fit within the outer base through the open top of the outer base, wherein the collar includes a helical slot and a channel on an inner surface of the collar;

a shell configured to fit within the collar through the open top of the collar, the shell having an open top, a bottom, and at least one longitudinal slot extending from the bottom of the shell;

a cup configured to fit within the shell through the open top of the shell, the cup having an open top and an open bottom, wherein the cup includes at least one post on an outer surface of the cup configured to extend through the at least one longitudinal slot of the shell and interact with the helical slot of the collar;

a cap configured for coupling to the base assembly;

wherein the cup includes a ledge within the cup thereby creating a cavity to hold a cosmetic product; and wherein the base assembly, the shell, the cup and the cap are all formed from a same material.

2. The cosmetic container of claim 1, wherein the material is polyethylene terephthalate glycol.

3. The cosmetic container of claim 1, wherein the shell includes an outer ridge configured to engage with the channel on the inner surface of the collar to secure the shell to the base assembly.

4. The cosmetic container of claim 1, wherein rotation of the base assembly relative to the shell in a first direction causes the at least one post on the outer surface of the cup to move along the helical slot of the collar thereby raising the cup.

5. The cosmetic container of claim 4, wherein rotation of the base assembly relative to the shell in a second direction causes the at least one post on the outer surface of the cup to move along the helical slot of the collar thereby lowering the cup.

6. The cosmetic container of claim 1, wherein the cap is secured to the base assembly in a snap-fit fashion.

7. A cosmetic container comprising:

a base assembly including an outer base having an open top and a closed bottom, the outer base having a plurality of notches on an inner surface of the outer base, and a collar configured to fit within the outer base through the open top of the outer base, the collar having an open top and an open bottom, a helical slot and a channel on an inner surface of the collar, an outer ridge on an outer surface of the collar, a plurality of ridges on the outer surface of the collar configured to engage with the plurality of notches on the inner surface of the outer base, and at least one protrusion on the outer surface of the collar;

a shell configured to fit within the collar through the open top of the collar, the shell having an open top and an open bottom, an outer ridge configured to engage with the channel on the inner surface of the collar to secure the shell to the base assembly, and at least one longitudinal slot extending from the open bottom;

a cup configured to fit within the shell through the open top of the shell, the cup having an open top and an open bottom, wherein the cup includes at least one post on an outer surface of the cup configured to extend through the at least one longitudinal slot of the shell and interact with the helical slot of the collar;

a cap that is removably coupled to the base assembly, the cap having an inner channel on an inner surface of the cap configured to engage with the at least one protrusion on the outer surface of the collar to secure the cap to the base assembly; and wherein the base assembly, the shell, the cup and the cap are all formed from a same material.

8. The cosmetic container of claim 7, wherein the material is polyethylene terephthalate glycol.

9. The cosmetic container of claim 7, wherein rotation of the base assembly relative to the shell in a first direction causes the at least one post on the outer surface of the cup to move along the helical slot of the collar thereby raising the cup.

10. The cosmetic container of claim 9, wherein rotation of the base assembly relative to the shell in a second direction causes the at least one post on the outer surface of the cup to move along the helical slot of the collar thereby lowering the cup.

11. The cosmetic container of claim 7, wherein the cup is configured to hold a cosmetic product.

12. The cosmetic container of claim 7, wherein the cap and the base assembly have generally the same shape.

13. The cosmetic container of claim 7, wherein the cup includes a ledge within the cup thereby creating a cavity to hold the cosmetic product.

14. The cosmetic container of claim 7, wherein the cap is secured to the base assembly in a snap-fit fashion.

15. The cosmetic container of claim 7, wherein the cup includes at least two posts on an outer surface of the cup configured to extend through the at least one longitudinal slot of the shell and interact with the helical slot of the collar.

16. A cosmetic container comprising:

a base assembly including an outer base having an open top and a closed bottom, the outer base having a plurality of notches on an inner surface of the outer base, and a collar configured to fit within the outer base through the open top of the outer base, the collar having an open top and an open bottom, a helical slot and a channel on an inner surface of the collar, an outer ridge on an outer surface of the collar, a plurality of ridges on the outer surface of the collar configured to engage with the plurality of notches on the inner surface of the outer base, and at least one protrusion on the outer surface of the collar;

a shell configured to fit within the collar through the open top of the collar, the shell having an open top and an open bottom, an outer ridge configured to engage with the channel on the inner surface of the collar to secure the shell to the base assembly, and at least one longitudinal slot extending from the open bottom;

a cup configured to fit within the shell through the open top of the shell, the cup having an open top and an open bottom, wherein the cup includes at least one post on an outer surface of the cup configured to extend through the at least one longitudinal slot of the shell and interact with the helical slot of the collar;

a cap that is removably coupled to the base assembly, the cap having an inner channel on an inner surface of the cap configured to engage with the at least one protrusion on the outer surface of the collar to secure the cap to the base assembly;

wherein rotation of the base assembly relative to the shell in a first direction causes the at least one post on the outer surface of the cup to move along the helical slot of the collar thereby raising the cup; and wherein rotation of the base assembly relative to the shell in a second direction causes the at least one post on the outer surface of the cup to move along the helical slot of the collar thereby lowering the cup.

17. The cosmetic container of claim 16, wherein the base assembly, the shell, the cup and the cap are all formed from a same material.

18. The cosmetic container of claim 17, wherein the material is polyethylene terephthalate glycol.

19. The cosmetic container of claim 16, wherein the cup is configured to hold a cosmetic product.

20. A cosmetic container and cosmetic product, comprising a cosmetic container as in claim 16, and a cosmetic product selected from the list consisting of a lipstick, a lip balm, a foundation stick, and a concealer.

* * * * *